US005497873A

United States Patent [19]

Hay

[11] Patent Number: 5,497,873

[45] Date of Patent: Mar. 12, 1996

[54] APPARATUS AND METHOD EMPLOYING AN INLET EXTENSION FOR TRANSPORTING AND METERING FINE PARTICULATE AND POWDERY MATERIAL

[75] Inventor: Andrew G. Hay, Gardena, Calif.

[73] Assignee: Stamet, Inc., Gardena, Calif.

[21] Appl. No.: 164,314

[22] Filed: Dec. 8, 1993

[51] Int. Cl.[6] ..... B65G 31/04

[52] U.S. Cl. ..... 198/642

[58] Field of Search ..... 198/617, 638, 198/642; 193/2 B, 10, 25 R; 406/96, 99

[56] References Cited

U.S. PATENT DOCUMENTS

| | | | |
|---|---|---|---|
| 1,489,571 | 4/1924 | Wright . | |
| 1,668,183 | 5/1928 | Albrecht . | |
| 2,045,081 | 6/1936 | Hart | 198/128 |
| 2,081,182 | 5/1937 | Malke et al. | 209/120 |
| 2,196,390 | 4/1940 | Gates | 198/642 X |
| 2,205,902 | 6/1940 | McMahan | 230/133 |
| 2,210,505 | 8/1940 | Sinden | 198/642 X |
| 2,318,881 | 5/1943 | Mundy | 198/128 |
| 2,427,659 | 9/1947 | Collyer . | |
| 2,568,536 | 9/1951 | Beech | 22/36 |
| 2,622,722 | 12/1952 | Lucas | 198/642 X |
| 2,626,571 | 1/1953 | Hoenecke | 103/135 |
| 2,637,375 | 5/1953 | Tapp et al. | 158/42.2 |
| 2,684,868 | 7/1954 | Berg | 302/17 |
| 2,684,870 | 7/1954 | Berg | 302/53 |
| 2,684,872 | 7/1954 | Berg | 302/53 |
| 2,684,873 | 7/1954 | Berg | 302/53 |
| 2,712,412 | 7/1955 | West | 230/134 |
| 2,843,047 | 7/1958 | Korber | 103/84 |
| 2,868,351 | 1/1959 | Hegmann | 198/128 |
| 3,086,696 | 4/1963 | Heine-Geldern | 230/42 |
| 3,150,815 | 9/1964 | Laing | 230/42 |
| 3,592,394 | 7/1971 | Sinden | 239/669 |
| 3,643,516 | 2/1972 | Jacobson | 74/5 |
| 3,765,216 | 10/1973 | Green | 72/262 |
| 3,889,588 | 6/1975 | Wollersheim | 100/177 |
| 4,023,784 | 5/1977 | Wallace | 266/216 |
| 4,032,254 | 6/1977 | Bentz et al. | 415/54 |
| 4,043,445 | 8/1977 | Wirth et al. | 198/611 |
| 4,076,460 | 2/1978 | Roof | 417/236 |
| 4,177,005 | 12/1979 | Bozung et al. | 415/128 |
| 4,193,737 | 3/1980 | Lemmon | 406/99 |
| 4,274,527 | 6/1981 | Baker | 193/2 B X |
| 4,335,994 | 6/1982 | Gurth | 406/99 |
| 4,409,746 | 10/1983 | Beck | 406/96 |
| 4,516,674 | 5/1985 | Firth | 198/642 X |
| 4,597,491 | 7/1986 | Conklin | 198/642 |
| 4,616,961 | 10/1986 | Burrough et al. | 406/99 |
| 4,678,076 | 7/1987 | Neakhov et al. | 198/525 |
| 4,768,920 | 9/1988 | Gurth | 415/90 |
| 4,773,819 | 9/1988 | Gurth | 415/90 |
| 4,832,554 | 5/1989 | Gaskin | 414/189 |
| 4,972,970 | 11/1990 | Toerner | 193/2 B X |
| 4,988,239 | 1/1991 | Firth | 198/642 X |
| 5,051,041 | 9/1991 | Firth | 198/642 X |
| 5,137,220 | 8/1992 | Rose et al. | 198/642 X |
| 5,356,280 | 10/1994 | Ponzielli | 425/201 |

FOREIGN PATENT DOCUMENTS

| | | | |
|---|---|---|---|
| 725012 | 5/1932 | France | 406/99 |
| 1220175 | 2/1968 | United Kingdom . | |
| 1379075 | 1/1972 | United Kingdom . | |
| 8000472 | 4/1980 | WIPO | 406/99 |

OTHER PUBLICATIONS

PCT International Search Report, Feb. 17, 1995.

*Primary Examiner*—James R. Bidwell
*Attorney, Agent, or Firm*—Spensley Horn Jubas & Lubitz

[57] ABSTRACT

A solids pump apparatus for transporting and metering particulate material including a transport channel having an inlet and an outlet. The transport channel is formed between substantially opposed faces of first and second rotary discs movable between the inlet and outlet towards the outlet and at least one arcuate wall extending between the inlet and outlet. The apparatus further includes an inlet extension and a device provided adjacent the inlet extension for improving the flow of the fine and powdery particulate solids within the apparatus.

32 Claims, 6 Drawing Sheets

APPARATUS AND METHOD EMPLOYING AN INLET EXTENSION FOR TRANSPORTING AND METERING FINE PARTICULATE AND POWDERY MATERIAL

BACKGROUND OF THE INVENTION

1. Field of the Invention

The present invention relates generally to apparatuses with improved inlets and methods for transporting and metering particulate material, and, in particular embodiments, to a particulate material handling device which can be used to facilitate the transportation of fine particulate and powdery material.

2. Description of Related Art

A wide variety of equipment has been used to either transport or meter particulate material. Such transport equipment includes conveyor belts, rotary valves, lock hoppers, screw-type feeders, etc. Exemplary measurement or metering devices include weigh belts, volumetric hoppers and the like. In order to provide both transport and metering of particulate material, it has generally been necessary to combine or incorporate both types of devices into a system.

Some prior pump devices were provided with the capability of both transporting and metering particulate material. Examples of such prior designs include the rotary disk type pumps discussed in the following U.S. patents, each of which is assigned or licensed to the assignee of the present invention and each of which is incorporated herein by reference: U.S. Pat. No. 4, 516,674 (issued May 14, 1895); U.S. Pat. No. 4,988,239 (issued Jan. 29, 1991); and U.S. Pat. No. 5,051,041 (issued Sep. 24, 1991). Rotary disk type pumps as described in these patents include a pair of rotary disks which provide two moveable drive walls and a transport duct or channel therebetween.

In rotary disk type pumps such as described in the above referenced patents, particulate material enters a transport duct between two drive disk walls and is driven by movement of the drive walls from an inlet toward an outlet. The movement of the drive walls causes the particles of particulate materials to interlock with each other, with the outermost particles engaging the drive walls, such that drive force is transferred from the drive walls to the particles.

As the particulate material enters the transport duct, it should be sufficiently compacted or compressed prior to or upon entry into the pumping apparatus to cause the formation of a transient solid or bridge composed of substantially interlocking particulate spanning the width of a transport channel defined between the drive walls. Successive bridges occur cumulatively within the transport duct as further particulate material enters the inlet. Various methods and devices to improve the formation of a transient solid and to otherwise improve the transportation of the particulate material are described in co-pending U.S. patent application Ser. No. 08/088,620 filed Jul. 6, 1993, co-pending U.S. patent application Ser. No. 08/076,314 filed Jun. 1, 1993, co-pending U.S. patent application Ser. No. 8/115,117 filed Aug. 31, 1993, co-pending U.S. patent application Ser. No. 08/116,229 filed Aug. 31, 1993, and copending U.S. patent application Ser. No. 08/115,173 filed Aug. 31, 1993, each of which are assigned to the assignee of the present invention and are incorporated herein by reference.

As a result of extensive testing and experimentation with moveable wall type particulate transporting devices, the present inventor has found that fine particulate and powdery materials, such as for example, cement limestone powder, wheat or other grain flour, and similar fine particulate and powdery materials, are difficult to effectively convey through the pumping system. Fine particulate and powdery materials tend to be aerated or well mixed with air when transported loosely or when loosely dropped through the inlet. The aerated fine particulate and powdery material may not be compacted enough to form a bridge between the rotary disks of the pumping device. As a result, the frictional force acting between the material and the rotary disks is not enough to provide a sufficient grip between the rotary disks and the material to transfer drive force to the material. Consequently, the fine particulate and powdery material may slip between the rotary disks and may not be effectively conveyed through the pumping device. On the other hand, if too much external force is applied to attempt to compress or de-aerate the powdery material, the material tends to over-compact together and clog the inlet or the transport channel.

Thus, there is a need in the industry for an effective moveable wall type particulate transporting system for transporting fine particulate and powdery materials.

SUMMARY OF THE DISCLOSURE

It is an object of embodiments of the present invention to provides an apparatus for transporting particulate materials which addresses the above-noted deficiencies of prior particulate material transporting systems.

It is a further object of embodiments of the present invention to provide a solids pump with an improved inlet structure which minimizes friction to encourage flow and allows fine particulate and powdery material to become sufficiently aerated and compacted to minimize the slippage of fine particulate and powdery material relative to the moveable wall(s).

These and other objects and advantages are achieved in a solids pump in which, according to embodiments of the present invention, fine particulate material, powdery material or a mixture thereof enters a transport duct located between two drive walls (such as, but not limited to, the facing walls of two parallel, opposed disks). Movement of the drive walls from an inlet toward an outlet causes the particles of the material to interlock with each other, with the outermost particles engaging the drive walls, such that drive force is transferred from the drive walls to the particles.

The inlet to the transport duct is improved so as to facilitate the compaction and/or de-aeration of fine particulate material and powdery material and avoid over-compaction of the materials. In this regard, the particles are compacted sufficiently to form a transient solid which engages the drive walls with minimal slipping between the transient solid and the drive walls, in which the movement of the particles is slowed or stopped. Embodiments comprise an inlet extension coupled for flow communication with the pump inlet.

An embodiment of an inlet extension comprises a hollow tubular structure having a vertical height sufficient to allow fine particulate and powdery materials passing therethrough to de-aerate a sufficient amount by its own weight and to compact together so as to be readily gripped by the moveable drive wall(s) of the pump. In order to avoid over-compaction and to improve the flow of the particulate materials through the inlet extension, the tubular structure of the extension may be configured so as to diverge towards the pump inlet. In addition or as an alternative to the diverging structure, the interior wall(s) of the inlet extension may be formed of (or have a peripheral layer of) a low friction material.

In further embodiments, a vibrator system is coupled to the inlet extension to avoid over-compaction and to improve the flow of the fine particulate material and/or the powdery material therethrough. In preferred embodiments, the vibrator system applies a primarily rotational vibration to the inlet extension, directed about the longitudinal axis of the inlet extension.

BRIEF DESCRIPTION OF THE DRAWINGS

The detailed description will be made with reference to the accompanying drawings, wherein like numerals designate corresponding parts in the several figures.

FIG. 7(*b*) is a partial side schematic view of the rotary vibrator assembly of FIG. 7(*a*).

DETAILED DESCRIPTION OF THE PREFERRED EMBODIMENT

The following detailed description is of the best presently contemplated mode of carrying out the invention. This description is not to be taken in a limiting sense, but is made merely for the purpose of illustrating general principles of embodiments of the invention. The scope of the invention is best defined by the appended claims.

Various embodiments of the invention are discussed below with respect to rotary disk type structures, wherein two spaced apart, opposing walls of a pair of parallel, rotary disks form drive walls, with a transport duct or channel therebetween. However, it will be recognized that further embodiments of the invention may be operable with, or provided with, drive walls formed from structures other than rotary disks, such as spaced moveable walls which move in a generally linear manner and define a transport duct or channel therebetween or single drive wall structures which define a transport duct or channel adjacent to the drive wall.

Figure 1:
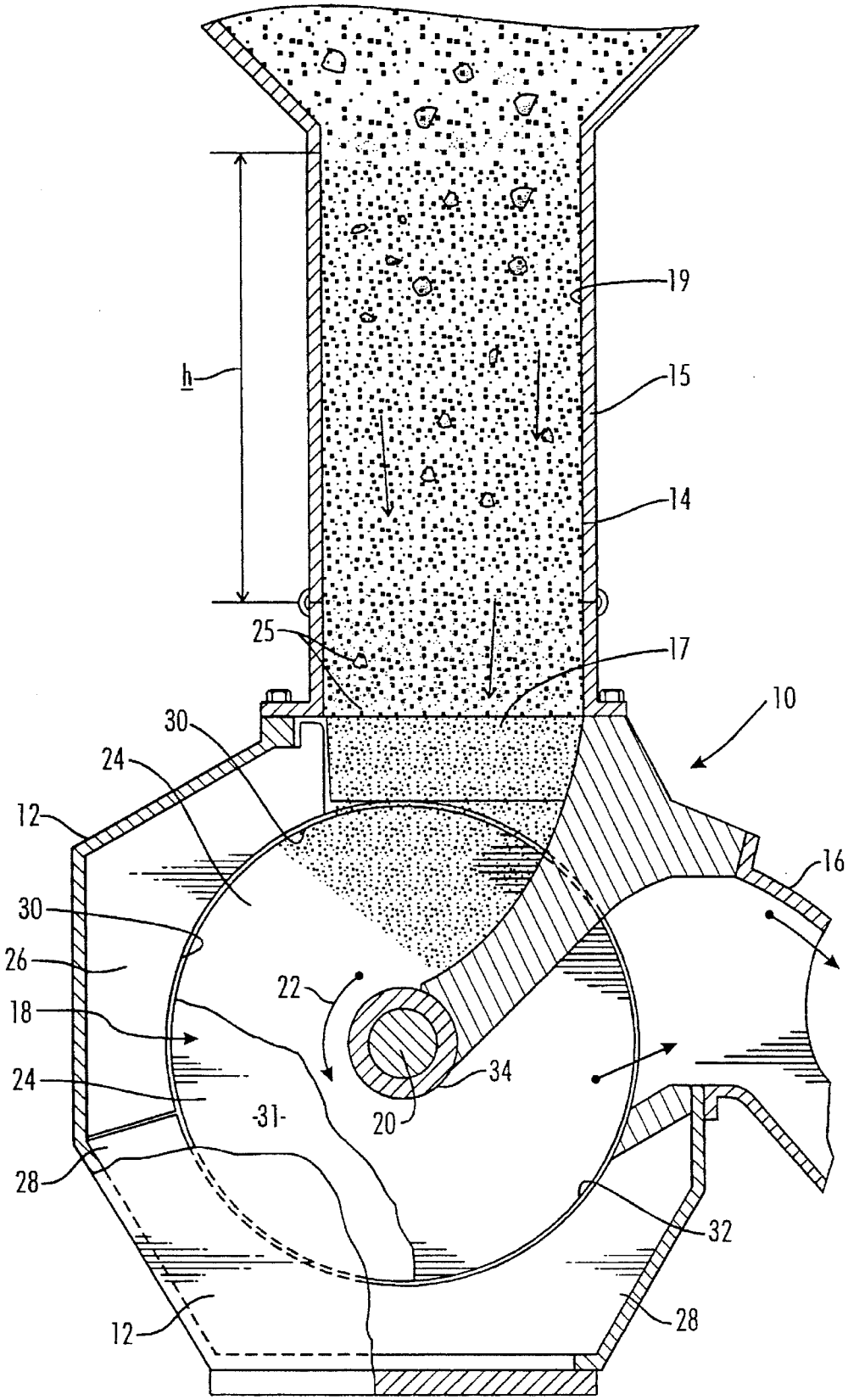
FIG. 1 is a partial sectional side view of a pump apparatus having an inlet extension in accordance with an embodiment of the present invention.

A particulate moving apparatus with an inlet extension according to an embodiment of the present invention is shown generally at 10 in FIG. 1. The apparatus 10 includes a housing 12, an inlet duct 14 and an outlet duct 16. A drive disk assembly 18 is rotatably mounted within the housing 12, on a shaft 20 for rotation about the axis of the shaft 20. Any suitable drive device, such as, but not limited to a hydrostatic or electrically-driven motor (not shown), may be operatively coupled to the drive disk assembly 18 (e.g., through the shaft 20) for rotatably driving the drive disk assembly 18 in the direction of arrow 22 in FIG. 1. The drive disk assembly 18 preferably includes a pair of spaced rotary disks 24 defining a transport duct or channel therebetween. Preferably, the disks 24 are separable in order to allow access to the interior of the pump apparatus and to facilitate servicing or replacement of parts of the apparatus.

The present inventor has recognized that various problems are encountered when attempting to convey fine particulate material, powdery material, or a combination thereof 25 (hereinafter collectively referred to as particulate material) (such as, for example, limestone powder, grain flour or the like) with moveable wall type particulate transporting devices. It is believed that the particulate material 25 tend to either become overly aerated and difficult to grip by the moveable wall(s), or become over-compressed and clog the inlet duct 14 or transport channel.

In particular, it is believed that over-aerated particulate material may not be sufficiently compacted to form a suitable bridge between the rotary disks 24 adjacent to the inlet duct 14. As a result, the frictional force acting between the particulate material and the rotary disks 24 may not reach a sufficient level to provide a good grip between the rotary disks and the particulate material. Consequently, the particulate material 25 tends to slip between the rotary disks 24 rather than being efficiently and effectively gripped and conveyed through the apparatus.

According to one embodiment, the inlet duct 14 has an inlet extension 15 configured to convey fine particulate material to the inlet port 17 of the pump and to de-aerate the particulate material during conveyance. The inlet extension 15 preferably has a generally cylindrical body which extends substantially vertically to a predetermined height h. According to another embodiment, the inlet extension 15 may be angled with respect to the vertical line.

As a volume of particulate material 25 moves down through the inlet extension 15, the particulate material 25 gradually deaerates. As a result, the particulate material 25 achieves a certain degree of compaction by its own weight adjacent to an inlet port 17 and forms relatively strong cumulative bridges between the rotary disks 24 adjacent the inlet port 17. As a consequence, the particulate material 25 is effectively conveyed into the transport channel and driven by the motion of the rotary disks 24 without substantial slipping between the particulate material and the internal surfaces of the rotary disks.

The inlet extension 15 may be made separately from the inlet duct 14 and connected to the inlet duct 14 by any appropriate means, such as welds, coupleable flanges, bolts connectors or the like. Alternatively, the inlet extension 15 and the inlet duct 14 may be formed as a unitary structure.

It has been recognized that the ability of the particulate material 25 to de-aerate and to achieve a suitable degree of compaction within the inlet extension 15 is dependant on the density and the internal friction of particles composing the particulate material 25. It is further recognized that the length and/or height of the inlet extension 15 to achieve a suitable compaction is determined by the ability of the particulate material 25 to de-aerate and the time required to achieve such a suitable compaction. Different particulate materials will de-aerate at different rates. Thus, according to one embodiment of the present invention, the length of the inlet extension is designed so as to allow sufficient de-aeration of the specific material(s) for which the inlet extension is to convey.

It is noted that the time required for de-aeration of the particulate material 25 is also affected by the friction between the particulate material and the internal wall(s) 19 of the inlet extension 15. In preferred embodiments, the internal surface 19 is made of or coated with a low friction material (such as for example, polytetrafluoroethylene or other suitable ultra-high molecular weight materials) to reduce friction between the particulate material 25 and the internal surface 19.

The preferred exemplary apparatus 10 includes one or more stationary wall components or shoes 26 and 28, as shown in FIG. 1. The shoes 26 and 28 close the primary transport channel 31 defined between interior faces of the rotary disks 24. Each of the shoes 26 and 28 includes a stationary inner wall 30 and 32, respectively. Inner walls 30 and 32, in combination with a hub 34 of the drive disk assembly 18 and opposing interior faces of the disks 24, define the cross-sectional area of the primary transport channel 31 at any given point.

Both exterior shoes 26 and 28 are mounted to the housing by way of suitable mounting brackets or pins. The inner wall, or inner walls in the case of plural shoes, are accurately formed so as to conform to the circular perimeter of the rotary discs 24. Therefore, as the rotary discs 24 rotate with the shaft 20, the stationary wall of each shoe maintains the transported particulate material 25 between the opposing interior faces of the disks 24. In one preferred embodiment, the inner wall of the shoe extends axially (transversely of the shoe) beyond the interior surfaces of the drive rotors 24 so as to overlap the interior surfaces of the drive rotors 24. The shoe is placed as close as possible, within acceptable tolerances, to the outer diameters of interior faces of the drive rotors 24. In the FIG. 1 configuration, the shoes are not radially adjustable (i.e., moveable closer or further away from the hub 34) to change the cross-sectional area of the primary transport channel 30. In a further embodiment, a stationary wall (which may be an interior wall of the housing) may be employed as an alternative to the shoes and shoe walls 30 and 32.

In an alternative embodiment, the shoes may be sized and shaped so as to fit between opposing interior faces of the drive rotors 24 to form a curved outer wall for the primary transport channel 30. In this configuration, the radial location of the shoe may be adjusted toward or away from the hub 34 of the drive rotors 24 so as to change the cross-sectional area of the primary transport channel 30 and to select the general configuration of the duct as one of a generally diverging duct (diverging from the inlet towards the outlet), converging duct (converging from the inlet towards the outlet), constant cross-sectional area duct or a duct having a combination of diverging, converging and/or constant cross-section portions. For this purpose, a screw adjuster may be connected to one or a plurality of shoes as shown in U.S. Pat. No. 4,988,239, incorporated herein by reference. The inward and outward adjustment of shoe allows setting up a choking or compaction of the solids as they move through the pump or, alternatively, to provide a diverging or a constant cross-sectional area along the duct.

In a further embodiment of the present invention, convergence or divergence of the cross-sectional area of the duct 30 and/or compaction of particulate material 25 is accomplished by positioning one of the rotary discs 24 at an angle relative to the other such that the distance between the opposing interior faces of the rotary disks 24 adjacent the inlet duct 14 is different than the distance between opposing interior faces of the rotary disks 24 between inlet 14 and outlet 16. In further embodiments, the angle at which the rotary disks rotates relative to each other may be adjusted. Variation of the angle modifies the rate of change of the cross-sectional area between the inlet and the outlet to provide a different convergence or choke (or divergence) in the duct. Various aspects of the foregoing and alternative preferred arrangements for accomplishing compaction are more fully described in U.S. patent application Ser. No. 07/929,880 (assigned to the assignee of the present invention and incorporated herein by reference).

Figure 2:
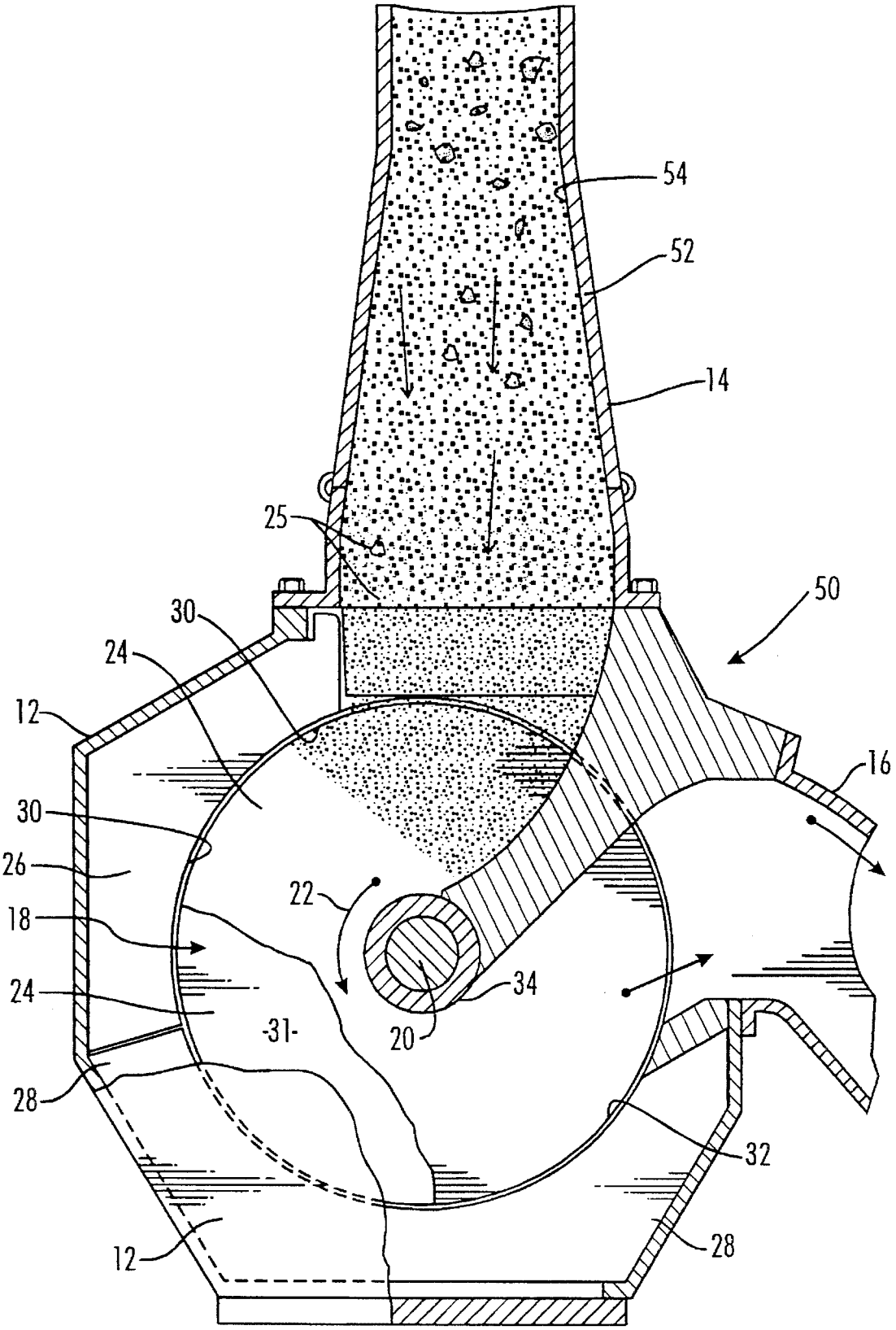
FIG. 2 is a partial sectional side view of a pump apparatus having an inlet extension in accordance with another embodiment of the present invention.

FIG. 2 shows an apparatus 50 with an inlet extension 52 in accordance with another embodiment of the present invention. Components of the apparatus 50 which are similar to components of the apparatus 10 described above with reference to FIG. 1 are shown with common reference numbers. In the FIG. 2 embodiment, the inlet extension 52 has a diverging tubular body 52 in which the cross-sectional area of the tubular body 52 gradually increases toward the inlet duct 14. The diverging cross-sectional area of the inlet extension 52 facilitates the downward movement of the particulate material 25 through the inlet extension 52, by effectively reducing the frictional resistance between the interior wall of the inlet extension and the particulate material 25. In the illustrated embodiment, the inlet extension 52 is divergent only at the lower extent of its length. However, in further preferred embodiments, the inlet extension may be divergent (diverging in the direction toward the inlet port 17) along its entire length.

As the particulate material 25 moves down through the inlet extension 52, the particulate material 25 de-aerates and compacts to a degree by its own weight. As a result, the particulate material 25 achieves a certain degree of de-aeration and compaction adjacent the inlet port 17 and forms relatively strong cumulative bridges between the rotary disks 24 adjacent the inlet port 17. Accordingly, the suitably compacted particulate material 25 is effectively gripped and moved between the rotary disks 24 without substantial slippage between the particulate material 25 and internal surfaces of the rotary disks 24.

Figure 3:
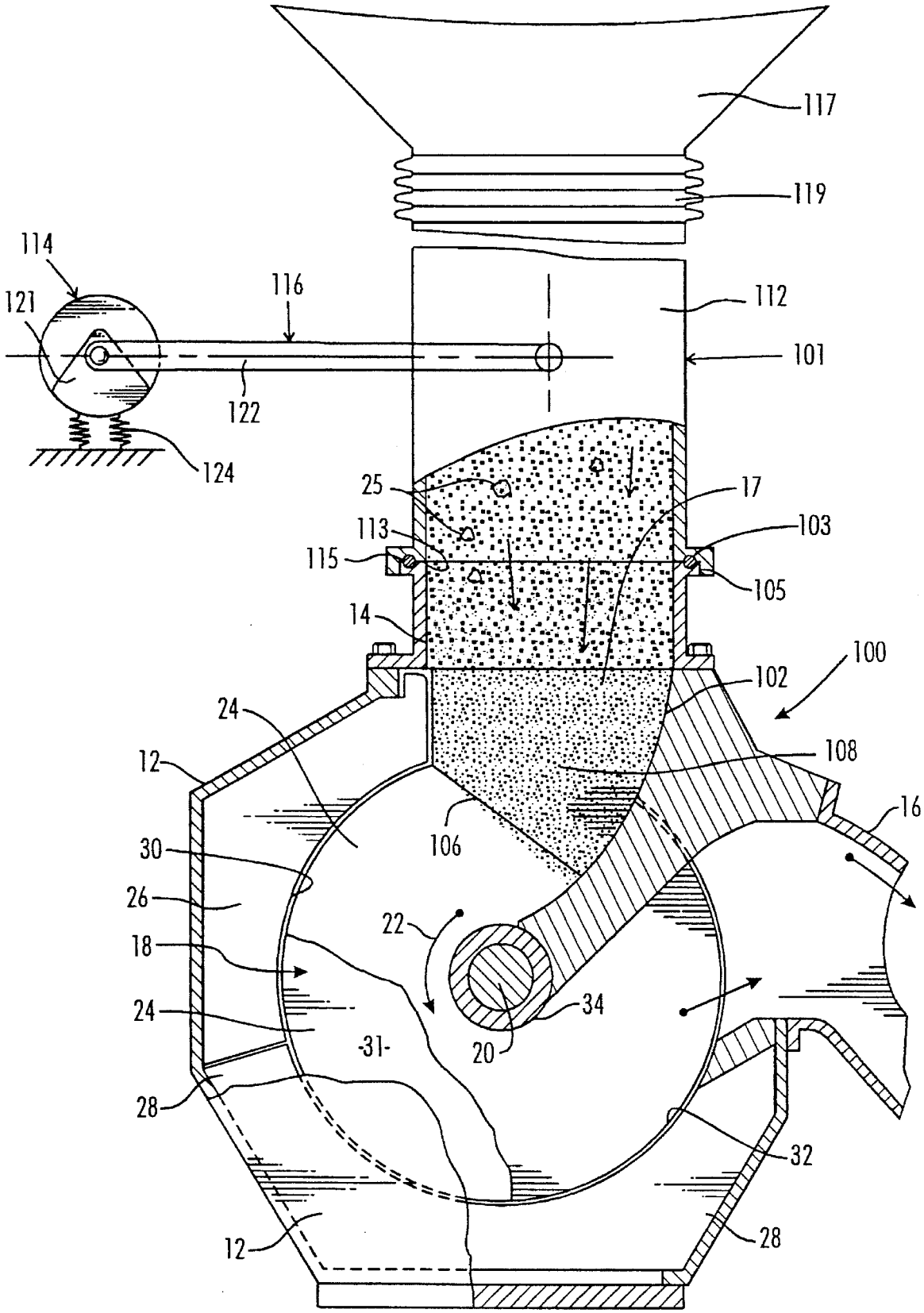
FIG. 3 is a partial sectional side view of a pump apparatus having a rotary vibrator assembly coupled to the inlet extension in accordance with another embodiment of the present invention.

FIG. 3 shows an apparatus 100 with an inlet extension system 101 in accordance with still another embodiment of the present invention which will be later described in greater detail. The apparatus 100 may have a construction similar to that described above with reference to FIG. 1. In preferred embodiments, the apparatus 100 further includes a shroud member assembly 102 provided adjacent the inlet 17 between the two rotary disks 24.

Figure 4:
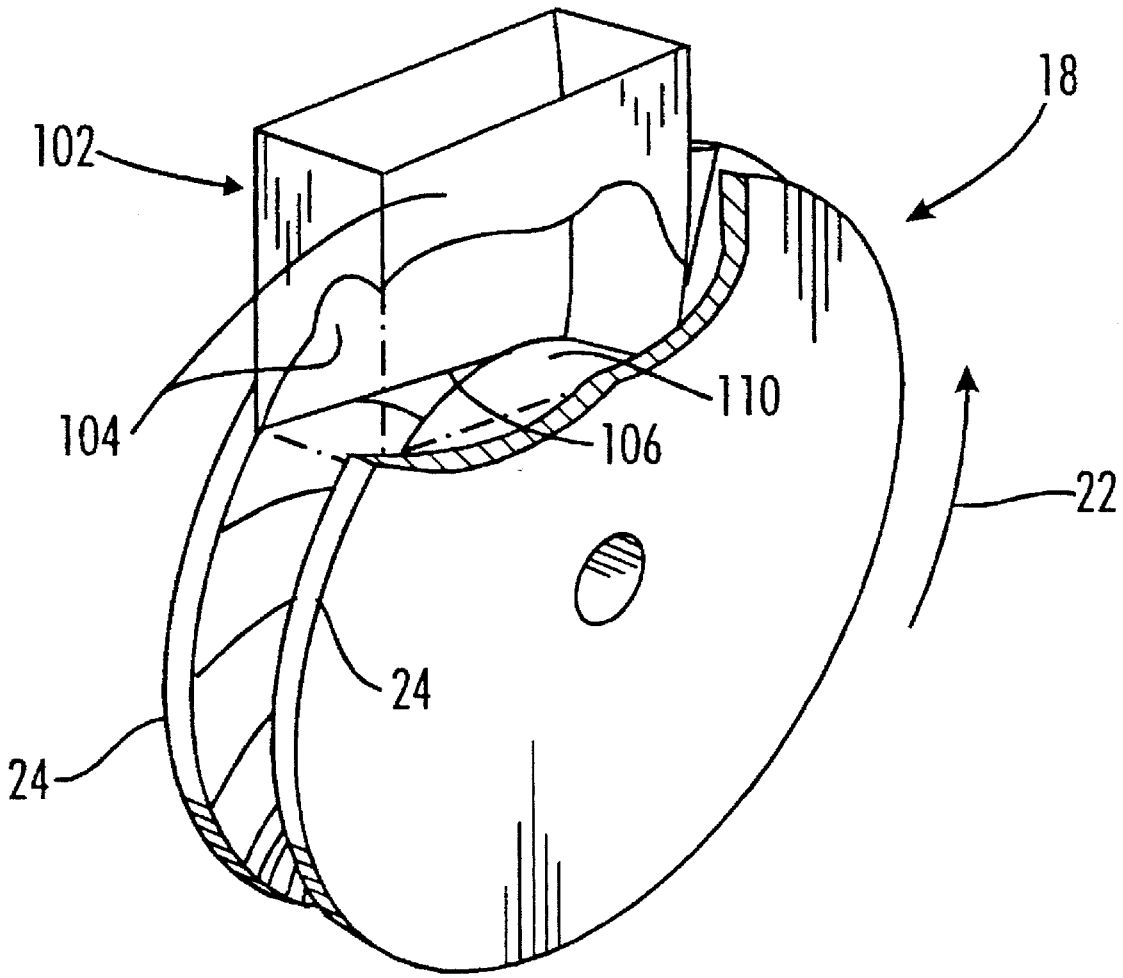
FIG. 4 is a perspective cut away view of a drive rotor of the apparatus in FIG. 3, showing a preferred shroud member assembly provided between moveable drive walls.

FIG. 4 shows an apparatus with a shroud member assembly 102. The shroud member assembly comprises plate members 104 which oppose and cover a portion of the surfaces of the two rotary disks 24 adjacent the inlet 17 port. Each plate member 104 is arranged adjacent a respective disk 24 and terminates at a bottom end 106 in an initial engagement area 108 (FIG. 3) of the transport duct 31. Various aspects of the shroud member assembly and further preferred arrangements thereof are fully described in U.S. patent application Ser. No. 08/115,173 (assigned to the assignee of the present invention and incorporated herein by reference).

As a result, the shroud member assembly 102 substantially inhibits the particulate material 25 introduced into the initial area 108 from contacting portions of the surfaces of the rotary disks 24 adjacent the inlet port 17. The shroud member assembly 102, thus, minimizes or eliminates the tangential thrust which would otherwise move the particulate material 25 adjacent the periphery of the rotary disks 24 toward a choke side wall 110 of the inlet duct 14 to form a mass of slow moving or stopped particles (a dead region).

Referring back to FIG. 3, the inlet extension system 101 has a generally cylindrical tubular body 112. A vibrator device 114 is coupled through a rod assembly 116 to the cylindrical body 112. The vibrator device 114 is designed to provide the cylindrical body 112 with a primarily or solely horizontal rotational movement or horizontal torsional vibrations (directed about the longitudinal axis of the cylindrical body 112).

The present inventor has recognized that the horizontal torsional vibrations of the cylindrical body 112 tends to improve the flow of the fine solid particles moving adjacent the internal wall of the cylindrical body 112 and substantially minimize the frictional effects of particles contacting the internal wall of the cylindrical body 112. Thus the solid particles moving through the cylindrical body 112 effectively behaves as though they were contained within a generally frictionless tube. As a result, the horizontal torsional vibrations of the cylindrical body 112 substantially reduce the time required for de-aeration of the particulate material 25 moving through the cylindrical body 112 and inhibits the particulate material from adhering to the interior walls of the cylindrical body and obstructing the normal flow.

The cylindrical body 112 is rotatably supported on a bearing system 103 and substantially sealingly coupled to the inlet duct 14. The bearing system 103 may be selected from any one of appropriate bearing devices, such as for example, a ball bearing housing, roller bearing housing, a smooth surface bearing system and a combination thereof. The smooth surface bearing system (not shown) comprises two smooth surfaces slidably abutting each other. For example, the bottom end of the cylindrical body 112 may be provided with a smooth end surface 113 which contacts a smooth top end surface 115 of the inlet duct 14.

The vibratory motion is preferably transferred to the cylindrical body 112 by a guide member 105. The guide member 116 is adapted to guide the rotational movement of the cylindrical body 112 in only one horizontal plane about the longitudinal axis of the cylindrical body 112 and to restrict the cylindrical body 112 from vibrating or moving in directions other than the horizontal plane. Vibrations which might otherwise occur in the direction of the longitudinal axis tend to cause the particulate material within the inlet extension to over-compress and clog the inlet extension.

In accordance with an embodiment, as shown in FIG. 3, the cylindrical body 112 may be connected to the bottom end portion of a standard hopper 117 through a flexible rubber gator or bellows 119. In the illustrated embodiment, the cylindrical body 112 directly sits on the bearing system 103 and/or the top end surface of the upper portion of the inlet duct 14. However, in further embodiments, the cylindrical body 112 may be supported and guided by an appropriate suspension system (not shown) and coupled to the inlet duct 14 through flexible rubber bellows (not shown).

The extension system 101 is preferably designed to provide horizontal rotations or horizontal torsional vibrations to the cylindrical body 112 and minimize vibrations or movements in directions other than the horizontal plane. As discussed above, vibrations of the cylindrical body 112 in the vertical direction tend to result in undesirable over-compaction of particulate material moving through the cylindrical body 112.

Figure 5:
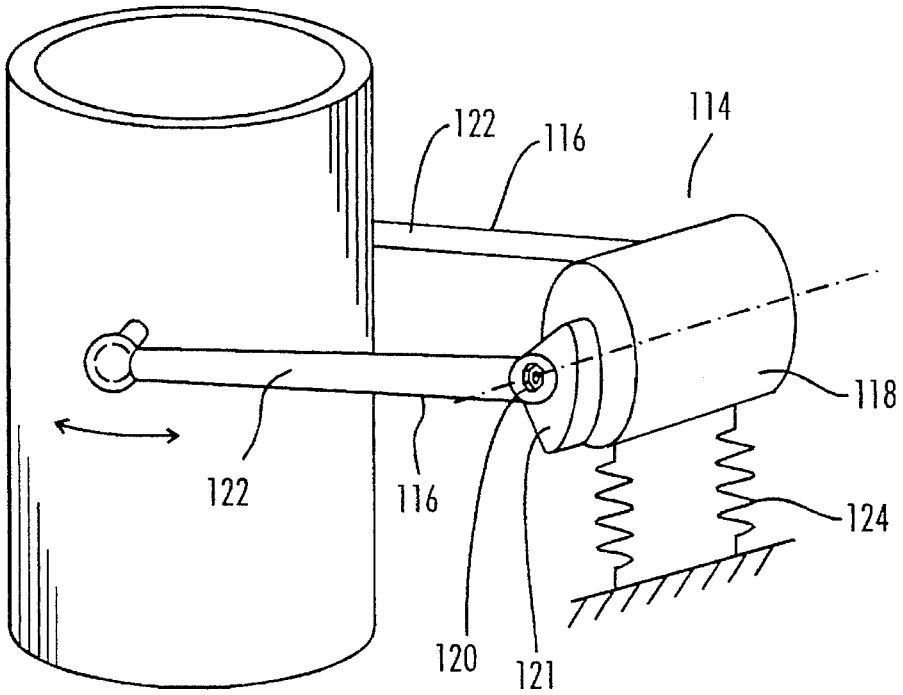
FIG. 5 is a perspective schematic view of the rotary vibrator assembly shown in FIG. 3.

According to one embodiment, as best shown in FIG. 5, the vibrator device 114 comprises a mass vibrator having a vibrator body 118 with a rotary shaft 120 extending beyond both ends of the vibrator body. Eccentric weights 121 are affixed to the ends of the rotary shaft 120, approximately 180 degrees out of phase from each other. To translate vibrations of the vibrator device 114 into primarily or solely horizontal torsional vibrations of the cylindrical body 112, the rod assembly 116 is pivotally coupled to each of the cylindrical body 112 and the vibrator device 114.

In a preferred embodiment, the rod assembly 116 includes ball ended connecting rods 122. One end of the ball ended connecting rod 122 is rotatably coupled to the end portion of the rotary shaft 120 of the vibrator device 114 (or may be pivotally connected to each side of the vibrator body 118 or an eccentric weight 121). In a further preferred embodiment, the vibrator device 114 may include an end cap (not shown) on each side of the vibrator body 118 to cover each eccentric weight 121, and each end of the ball ended connecting rod 122 may be connected to the end cap. Furthermore, the vibrator device 114 is suspended or supported by a spring system 124 which provides sufficient suspension or support to the vibrator device 114 but does not substantially restrict the vibratory motion of the vibrator device 114. While the illustrated embodiment shows the spring system 124 as supporting the vibrator device 114 from the bottom of the vibrator device, further embodiments may employ a spring or suitable suspension system for supporting the vibrator device from the top or sides of the device.

Figure 6:
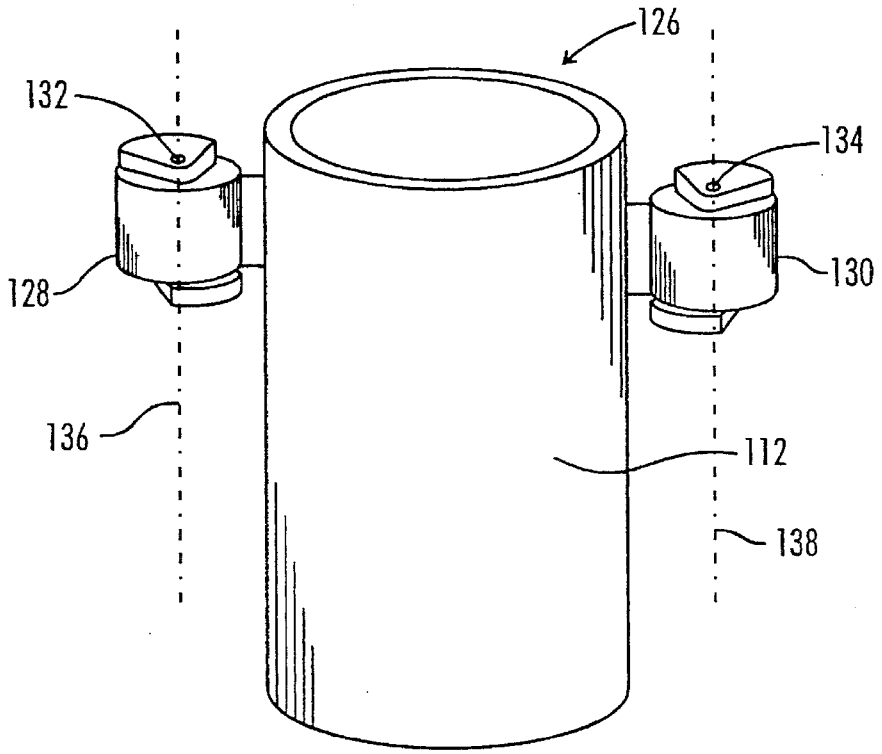
FIG. 6 is a perspective schematic view of a rotary vibrator assembly with two vibrators according to another embodiment of the present invention.

FIG. 6 shows an inlet extension system 126 in accordance with another embodiment of the present invention. The inlet extension system 126 includes two vibrator devices 128 and 130 attached to opposing sides of the cylindrical body 112. Each of the two vibrator devices 128 and 130 is preferably a mass vibrator, having a rotary shaft 132 and 134, respectively. The vibrator devices 128 and 130 are attached to the sides of the cylindrical body 112 so that the rotary shafts 132 and 134 are generally parallel with the longitudinal axis of the cylindrical body. Moreover, the vibrator devices 128 and 130 are mounted on diametrically opposite sides of the cylindrical body 112 and are 180 degrees out of phase with each other such that movements or vibrations of the mass vibrators in the direction of the vertical axes are canceled, and only vibrations in the horizontal direction are transferred to the cylindrical body 112 to cause horizontal torsional vibrations of the cylindrical body 112.

In a preferred embodiment, a pair of eccentric weights 136 and 138 is affixed to ends of each of the rotary shaft 132 and 134, respectively. While each of the pair of eccentric weights 136 and 138 may be adjusted in the same phase, the pair of eccentric weights 136 may be set approximately 180 degrees out of phase from the pair of eccentric weights 138.

Figure 7A:
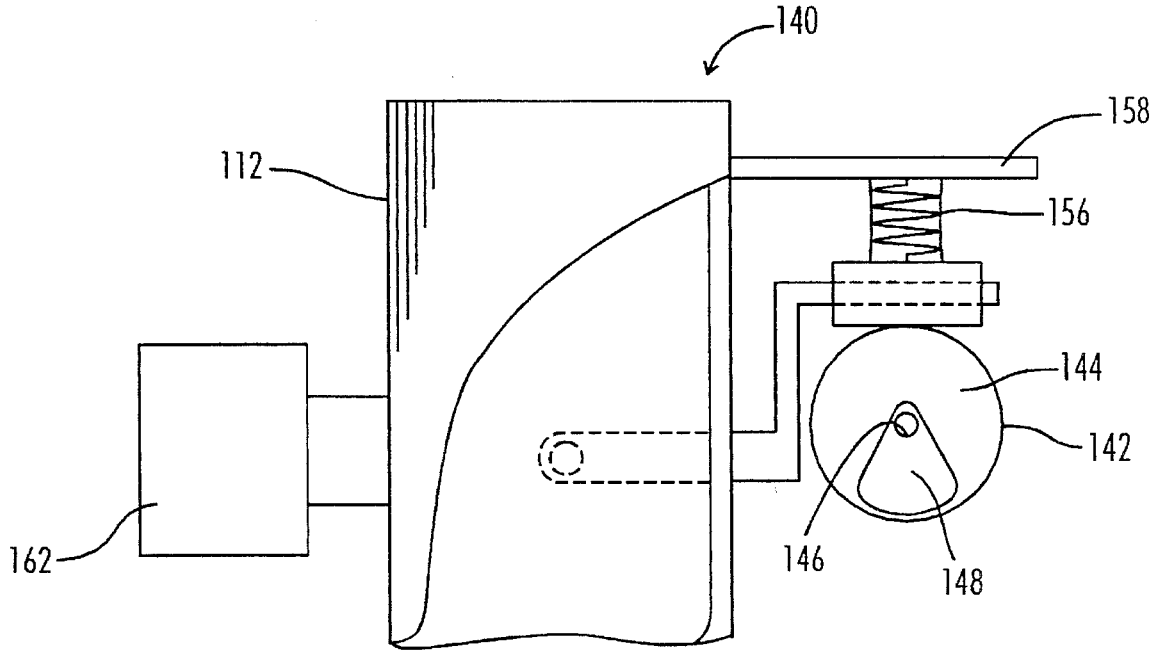
FIG. 7(*a*) is a partial front schematic view of a rotary vibrator assembly with a single vibrator according to another embodiment of the present invention.
Figure 7B:
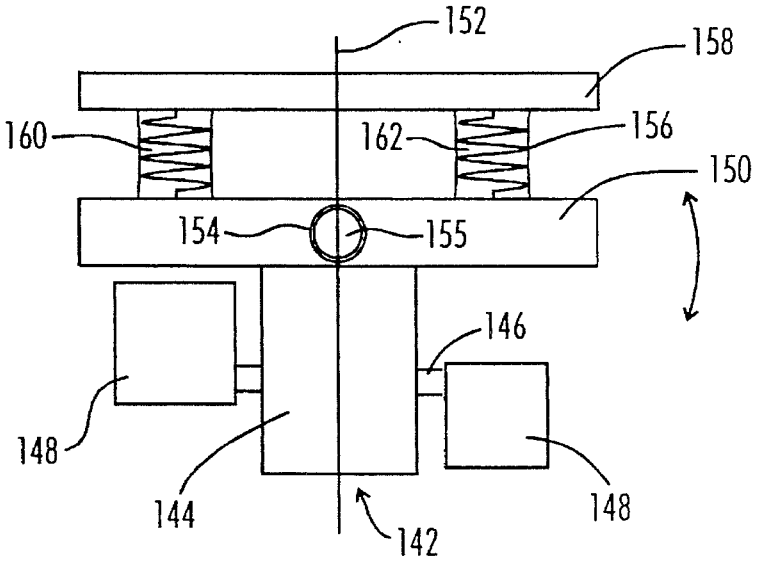

FIGS. 7(*a*) and 7(*b*) show an inlet extension system 140 in accordance with another embodiment of the present invention. The inlet extension system 140 includes a single vibrator device 142. In one embodiment, the vibrator device 142 has a vibrator body 144 with a rotary shaft 146 extending beyond both ends of the vibrator body. An eccentric weight 148 is affixed on each end of the rotary shaft 146. The weights 148 on each end of the rotary shaft 146 are 180 degrees out of phase from each other.

The vibrator body 144 is connected to a base member 150 about a center 152 thereof. The base member 150 defines a horizontal bore 154 at the center 152 which receives a pivot pin 155. The pivot pin 155 is pivotally connected to the outer wall of the cylindrical body 112. The base member 150 and the vibrator device 142 are suspended by a spring system 156 from a support frame member 158 which may be affixed to the cylindrical body 112 or to any stationary structure (not shown) in the vicinity of the support frame member.

In the illustrated embodiment, the spring system 158 comprises two springs 160 and 162 substantially symmetrically positioned about the center 152. Other embodiments may employ more or less springs. The springs 160 and 162 preferably have a relatively low spring tension so that the springs 160 and 162 generally freely suspend and support the vibrator device 142 with minimal restriction to the vibrational movement of the vibrator device 142.

If the support frame member is coupled to the cylindrical body 112, a counter weight 162 may be attached to the cylindrical body 112 to counter the weight of the vibrator device 142 and the support elements (including the support frame member 158 and the base member 150). As a result, the springs 160 and 162 allow a generally free swivelling motion of the base member 150 and the vibrator device 142 about the pivot pin 155. The generally free motion of the base member about the pivot pin 155 tends to absorb undesirable vertically directed vibrations. As a result, primarily or solely torsional vibrations (directed about the longitudinal axis of the cylindrical body—i.e., directed substantially perpendicular to the flow direction of the particulate material) are transferred to the cylindrical body 112.

In further embodiments, vibrator arrangements as described above, and equivalents thereof, may be coupled to inlet extensions having diverging cross-sections (as described above with reference to FIG. 2). While the above-discussed embodiments employ generally cylindrical shaped inlet extensions, other embodiments may employ inlet extensions of other suitable shapes (such as having oval or polygonal cross-section shapes). Moreover, a preferred embodiment may employ a combination of any of the above described features, i.e., the high inlet extension duct, the inlet extension duct with diverging cross-sections, the shroud plate member assembly and the vibrator arrangements.

The apparatus elements are preferably made of high strength steel or other suitable material. The interior surfaces of the inlet extension, drive discs and the interior walls of the shoes are preferably made of an abrasion-resistant metal or other suitable material having non-adhesive qualities to facilitate discharge during operation and to facilitate cleaning during maintenance. In suitable applications, the interior surfaces of the rotary discs and the interior wall of the shoes may be composed of a material such as polytetrafluoroethylene.

The presently disclosed embodiments are to be considered in all respects as illustrative and not restrictive. The scope of the invention being indicated by the appended claims, rather than the foregoing description, and all changes which come within the meaning and range of equivalency of the claims are, therefore, intended to be embraced therein.

I claim:

1. An inlet extension for an apparatus for transporting fine or powdery material, wherein the transporting apparatus has a particulate transport channel and an inlet provided in flow communication with the transport channel, the inlet extension comprising:

a generally tubular body defining a longitudinally directed axis and a generally hollow interior having an outlet for arranging in flow communication with the inlet of the particulate material transporting apparatus;

the generally hollow interior of the tubular body being configured to allow particulate material to pass therethrough by gravity along the longitudinal axis toward the outlet;

the generally tubular body having an axial length suitable for allowing the particulate material to become relatively compacted upon flowing through the hollow interior and into the transport channel of the particulate material transporting apparatus;

wherein the generally hollow interior of the tubular body defines a radial cross-sectional area which diverges in the longitudinal direction toward the outlet.

2. An inlet extension according to claim 1, further comprising:

a coupler for coupling the generally tubular body to the inlet of the particulate material transporting apparatus to provide the hollow interior in flow communication with the inlet of the particulate material transporting apparatus.

3. An inlet extension according to claim 2, wherein the coupler comprises a flexible tubular extension portion for coupling the outlet of the tubular body to the inlet of the particulate material transporting apparatus.

4. An inlet extension for an apparatus for transporting fine or powdery material, wherein the transporting apparatus has a particulate transport channel and an inlet provided in flow communication with the transport channel, the inlet extension comprising:

a generally tubular body defining a longitudinally directed axis and a generally hollow interior having an outlet for arranging in flow communication with the inlet of the particulate material transporting apparatus;

the generally hollow interior of the tubular body being configured to allow particulate material to pass therethrough along the axis toward the outlet; and a vibrator coupled to the tubular body for torsionally vibrating the tubular body about its longitudinally directed axis.

5. An inlet extension according to claim 4, wherein the vibrator includes a vibrator supporting structure coupled to the vibrator and the tubular body for communicating to the tubular body vibrations directed torsionally about the axis of the tubular body and for minimizing the communication of vibrations to the tubular body directed parallel with the axis of the tubular body.

6. An inlet extension according to claim 5, wherein the vibrator supporting structure includes a ball ended rod assembly coupled to the vibrator and the tubular body.

7. An inlet extension according to claim 5, wherein the vibrator supporting structure includes a resilient suspension system for resiliently suspending the vibrator.

8. An inlet extension as recited in claim 4, further comprising at least one guide member coupling the vibrator to a first location on the generally tubular body, the first location being laterally offset from the longitudinally directed axis, for imparting substantially horizontally directed vibrations on the first location of the tubular body to effect torsional vibrations of the generally tubular body about the longitudinally directed axis.

9. An inlet extension as recited in claim 8, wherein the generally tubular body defines an exterior peripheral surface circumferencing the longitudinally directed axis and wherein said first location is disposed on said exterior peripheral surface.

10. An inlet extension as recited in claim 9, wherein the at least one guide member comprises first and second guide members, said first guide member coupled to said first location and said second guide member coupled to a second location on the external peripheral surface of the generally tubular body, said second location being substantially 180° offset from said first location with respect to the longitudinally directed axis.

11. An inlet extension as recited in claim 4, wherein:

the generally tubular body defines an exterior peripheral surface circumferencing the longitudinally directed axis;

the vibrator is coupled to a first location on the exterior peripheral surface of the generally tubular body; and the inlet extension further comprises a second vibrator coupled to a second location on the exterior peripheral surface of the generally tubular body, said second location being substantially 180° offset from said first location with respect to the longitudinally directed axis; and the two vibrators are configured to vibrate approximately 180° out of phase with each other.

12. An inlet extension for an apparatus for transporting fine or powdery material, wherein the transporting apparatus has a particulate transport channel and an inlet provided in flow communication with the transport channel, the inlet extension comprising:

a generally tubular body defining a longitudinally directed axis and a generally hollow interior having an outlet for arranging in flow communication with the inlet of the particulate material transporting apparatus;

the generally hollow interior of the tubular body being configured to allow particulate material to pass therethrough along the axis toward the outlet; and a coupler for coupling the generally tubular body to the inlet of the particulate material transporting apparatus to provide the hollow interior in flow communication with the inlet of the particulate material transporting apparatus;

wherein the coupler includes a bearing assembly for supporting the tubular body for rotation about the axis of the tubular body.

13. An inlet extension for an apparatus for transporting fine or powdery material, wherein the transporting apparatus has a particulate transport channel and an inlet provided in flow communication with the transport channel, the inlet extension comprising:

a generally tubular body defining a longitudinally directed axis and a generally hollow interior having an outlet for arranging in flow communication with the inlet of the particulate material transporting apparatus:

the generally hollow interior of the tubular body being configured to allow particulate material to pass therethrough along the axis toward the outlet; and a coupler for coupling the generally tubular body to the inlet of the particulate material transporting apparatus to provide the hollow interior in flow communication with the inlet of the particulate material transporting apparatus;

wherein the coupler comprises a flexible tubular extension portion for coupling the outlet of the tubular body to the inlet of the particulate material transporting apparatus; and wherein the flexible tubular extension portion has a bellows-like configuration.

14. An inlet extension for an apparatus for transporting fine or powdery material, wherein the transporting apparatus has a particulate transport channel and an inlet provided in flow communication with the transport channel, the inlet extension comprising:

a generally tubular body defining a longitudinally directed axis and a generally hollow interior having an outlet for arranging in flow communication with the inlet of the particulate material transporting apparatus;

the generally hollow interior of the tubular body being configured to allow particulate material to pass therethrough along the axis toward the outlet; and a material hopper having an outlet for supplying the particulate material to the transport channel through the tubular body of the inlet extension, and a generally flexible tubular extension portion for connecting the tubular extension to the outlet of the material hopper.

15. An inlet extension according to claim 14, wherein the flexible tubular extension portion has a bellows-like configuration.

16. An improved apparatus for transporting particulate material of the type having a movable wall structure defining a transport channel and having an inlet for receiving particulate material into the channel and an outlet for emitting particulate material from the channel, wherein the movable wall structure defines at least one wall moveable in the direction from the inlet toward the outlet for imparting a force directed toward the outlet on particulate material entering the channel from the inlet, the improvement comprising:

an inlet extension having a longitudinally directed axis and a generally hollow interior having an outlet in flow communication with the inlet of the transport channel;

the generally hollow interior of the tubular body being configured to allow particulate material to pass therethrough by gravity along the axis toward the inlet of the transport channel; and the generally tubular body having an axial length suitable for allowing the particulate material to become relatively compacted upon flowing through the hollow interior and into the transport channel;

wherein the generally hollow interior of the tubular body defines a radial cross-sectional area which diverges in the longitudinal direction toward the outlet.

17. An inlet extension according to claim 16, further comprising:

a coupler for coupling the generally tubular body to the inlet of the particulate material transporting apparatus to provide the hollow interior in flow communication with the inlet of the particulate material transporting apparatus.

18. An inlet extension according to claim 16, further comprising a shroud member assembly covering a portion of the moveable wall adjacent the inlet for inhibiting the moveable wall from imparting a force on the particulate material as the material passes through the inlet.

19. An inlet extension according to claim 16, wherein the tubular body has an internal wall provided with a low friction material.

20. An apparatus according to claim 19, wherein the low friction material is polytetrafluoroethylene.

21. An improved apparatus for transporting particulate material of the type having a movable wall structure defining a transport channel and having an inlet for receiving particulate material into the channel and an outlet for emitting particulate material from the channel, wherein the movable wall structure defines at least one wall moveable in the direction from the inlet toward the outlet for imparting a force directed toward the outlet on particulate material entering the channel from the inlet, the improvement comprising:

an inlet extension having a longitudinally directed axis and a generally hollow interior in flow communication with the inlet of the transport channel;

the generally hollow interior of the tubular body being Configured to allow particulate material to pass therethrough along the axis toward the inlet of the transport channel; and a vibrator coupled to the tubular body for torsionally vibrating the tubular body about its longitudinally directed axis.

22. An inlet extension according to claim 21, wherein the vibrator includes a vibrator supporting structure coupled to the vibrator and the tubular body for communicating to the tubular body vibrations directed torsionally about the axis of the tubular body and for minimizing the communication of vibrations to the tubular body directed parallel with the axis of the tubular body.

23. An inlet extension according to claim 22, wherein the vibrator supporting structure includes a ball ended rod assembly coupled to the vibrator and the tubular body.

24. An inlet extension according to claim 22, wherein the vibrator supporting structure includes a resilient suspension system for resiliently suspending the vibrator.

25. An improved apparatus for transporting particulate material of the type having a movable wall structure defining a transport channel and having an inlet for receiving particulate material into the channel and an outlet for emitting particulate material from the channel, wherein the movable wall structure defines at least one wall moveable in the direction from the inlet toward the outlet for imparting a force directed toward the outlet on particulate material entering the channel from the inlet, the improvement comprising:

an inlet extension having a longitudinally directed axis and a generally hollow interior in flow communication with the inlet of the transport channel;

the generally hollow interior of the tubular body being configured to allow particulate material to pass therethrough along the axis toward the inlet of the transport channel; and a coupler for coupling the generally tubular body to the inlet of the particulate material transporting apparatus to provide the hollow interior in flow communication with the inlet of the particulate material transporting apparatus;

wherein the coupler includes a bearing assembly for supporting the tubular body for rotation about the longitudinal axis of the tubular body.

26. An improved apparatus for transporting particulate material of the type having a movable wall structure defining a transport channel and having an inlet for receiving particulate material into the channel and an outlet for emitting particulate material from the channel, wherein the movable wall structure defines at least one wall moveable in the direction from the inlet toward the outlet for imparting a force directed toward the outlet on particulate material entering the channel from the inlet, the improvement comprising:

an inlet extension having a longitudinally directed axis and a generally hollow interior in flow communication with the inlet of the transport channel;

the generally hollow interior of the tubular body being configured to allow particulate material to pass therethrough along the axis toward the inlet of the transport channel; and a coupler for coupling the generally tubular body to the inlet of the particulate material transporting apparatus to provide the hollow interior in flow communication with the inlet of the particulate material transporting apparatus;

wherein the coupler comprises a flexible tubular extension portion for coupling the outlet of the tubular body to the inlet.

27. An inlet extension according to claim 26, wherein the flexible tubular extension portion has a bellows-like configuration.

28. An improved apparatus for transporting particulate material of the type having a movable wall structure defining a transport channel and having an inlet for receiving particulate material into the channel and an outlet for emitting particulate material from the channel, wherein the movable wall structure defines at least one wall moveable in the direction from the inlet toward the outlet for imparting a force directed toward the outlet on particulate material entering the channel from the inlet, the improvement comprising:

an inlet extension having a longitudinally directed axis and a generally hollow interior in flow communication with the inlet of the transport channel;

the generally hollow interior of the tubular body being configured to allow particulate material to pass therethrough along the axis toward the inlet of the transport channel;

a material hopper having an outlet for supplying the particulate material to the transport channel through the tubular body of the inlet extension; and a generally flexible tubular extension portion for connecting the tubular extension to the outlet of the material hopper.

29. An inlet extension according to claim 28, wherein the flexible tubular extension portion has a bellows-like configuration.

30. A method for transporting fine and powdery particulate material in an apparatus having a transport channel, an inlet for receiving particulate material into the transport channel, an outlet for emitting particulate material from the transport channel, at least one moveable wall moveable in the direction from the inlet toward the outlet for imparting a force directed toward the outlet on particulate material entering the channel from the inlet, the method comprising the steps of:

coupling a generally hollow inlet extension to the transport channel inlet, the inlet extension having a predetermined vertical height and a generally hollow interior with a cross-sectional area that diverges in the direction toward the inlet of the transport channel;

passing a volume of the powdery particulate material by gravity through the generally hollow inlet extension and into the inlet and transport channel;

de-aerating the powdery particulate material within the inlet extension as the particulate material passes through the inlet extension so that the powdery particulate material becomes sufficiently compacted upon reaching the transport channel to form a transient solid for receiving a drive force from the at least one moveable wall; and engaging the transient solid with the at least one moveable wall such that the transient solid receives a drive force from the at least one moveable wall;

transporting the transient solid toward the outlet with the drive force imparted by the at least one moveable wall.

31. A method for transporting fine and powdery particulate material in an apparatus having a transport channel, an inlet for receiving particulate material into the transport channel, an outlet for emitting particulate material from the transport channel, at least one movable wall movable in the direction from the inlet toward the outlet for imparting a force directed toward the outlet on the particulate material entering the channel from the inlet, the method comprising the steps of:

coupling a generally hollow inlet extension to the transport channel inlet, the inlet extension having a generally hollow interior and a longitudinal axis directed along the length of the generally hollow interior;

passing a volume of particulate material through the generally hollow inlet extension and into the transport channel;

torsionally vibrating the generally tubular body circumferentially about the longitudinally directed axis to reduce the effect of friction between the generally tubular body and the particulate material.

32. A method as recited in claim 31, wherein said step of torsionally vibrating comprises the steps of:

coupling a vibrator to the generally tubular body, at a location on the generally tubular body offset from the longitudinally directed axis; and operating the vibrator to impart generally horizontally directed vibrations to the laterally offset location on the generally tubular body to effect torsional vibrations of the generally tubular body.

* * * * *